US008858006B2

(12) United States Patent
Lee

(10) Patent No.: US 8,858,006 B2
(45) Date of Patent: Oct. 14, 2014

(54) LIGHT EMITTING DIODE LAMP

(75) Inventor: Sung-Keun Lee, Huizhou (CN)

(73) Assignee: Je Woo Corporation, Ltd., Huizhou (CN)

( * ) Notice: Subject to any disclaimer, the term of this patent is extended or adjusted under 35 U.S.C. 154(b) by 314 days.

(21) Appl. No.: 13/411,472

(22) Filed: Mar. 2, 2012

(65) Prior Publication Data

US 2013/0170180 A1 Jul. 4, 2013

(30) Foreign Application Priority Data

Dec. 28, 2011 (CN) ..... 2011 1 0449333

(51) Int. Cl.
*F21V 33/00* (2006.01)

(52) U.S. Cl.
USPC ..... 362/92; 315/86; 362/20; 362/249.05; 362/294; 362/373

(58) Field of Classification Search
USPC ..... 315/86; 362/20, 92, 249.02, 249.05, 362/294, 373
See application file for complete search history.

(56) References Cited

U.S. PATENT DOCUMENTS 7,737,640 B2 * 6/2010 Marques et al. ..... 315/86

* cited by examiner

*Primary Examiner* — Stephen F Husar

(57) ABSTRACT

The LED lamp includes a housing, an LED chip, a control module, a battery and a heater with a temperature controlled switch. The housing is composed of a front cover and a back cover. The LED chip, control module and the battery are received in the housing. The control module is electrically connected to the LED chip for driving the LED chip. The battery is electrically connected to the control module for providing alternative power to the LED chip.

17 Claims, 7 Drawing Sheets

LIGHT EMITTING DIODE LAMP

BACKGROUND OF THE INVENTION

1. Technical Field

The invention relates to lamps, particularly to LED emergency lights with cold resistance.

2. Related Art

With development of light emitting diodes (LEDs) technology, LEDs have been progressively replacing traditional light sources because of advantages of low power consumption, great durability and less pollution.

An emergency light is a battery-backed lighting device that comes on automatically when a building experiences a power outage. Conventional emergency lights are not provided with cold resistant design. When an emergency light is placed in a cold environment, for example 0° C.~40° C., is performance of the battery in the emergency light will dramatically fall. Also, electrolytic capacitors will fail in a cold environment. It is possible that an emergency light cannot light up during a power outage in cold winter.

SUMMARY OF THE INVENTION

An object of the invention is to provide an LED lamp which can automatically warm up the battery when the temperature is too low.

To accomplish the above object, the LED lamp of the invention includes a housing, an LED chip, a control module, a battery and a heater with a temperature controlled switch. The housing is composed of a front cover and a back cover. The LED chip, control module and the battery are received in the housing. The control module is electrically connected to the LED chip for driving the LED chip. The battery is electrically connected to the control module for providing alternative power to the LED chip.

DETAILED DESCRIPTION OF THE INVENTION

Figure 1:
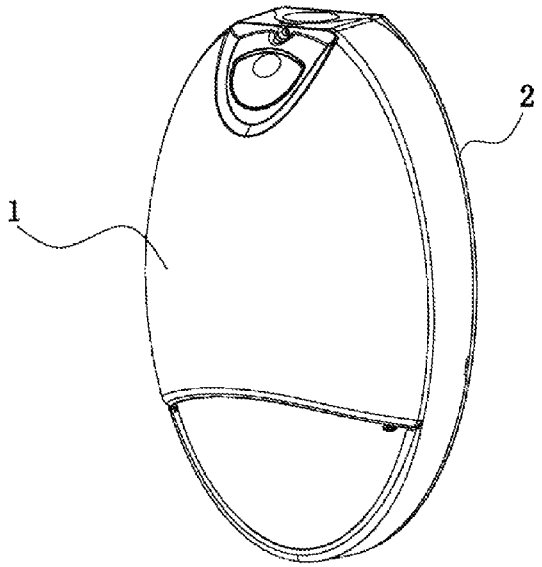
FIG. 1 is a perspective view of the invention.
Figure 2:
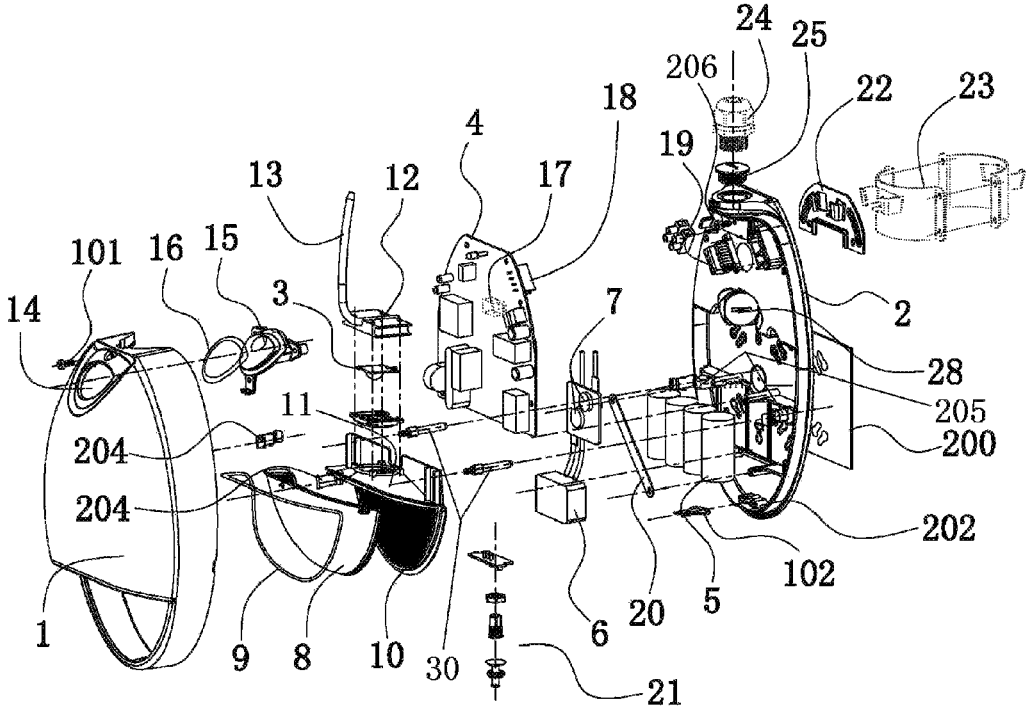
FIG. 2 is an exploded view of the invention.
Figure 3:
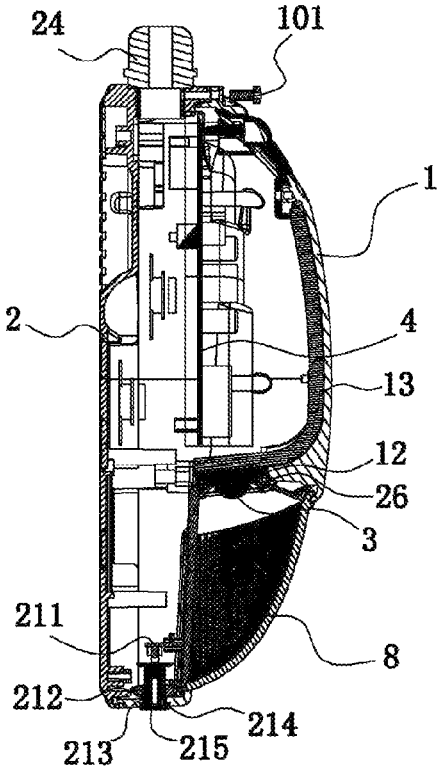
FIG. 3 is a cross-sectional view of the invention.

Please refer to FIGS. 1, 2 and 3. The LED lamp includes a housing composed of a front cover 1 and a back cover 2. The front cover 1 and back cover 2 are fastened by flexible members 204. A U-shaped spring 102 disposed in the front cover

1 is inserted into a trough 202 formed in the back cover 2. For assembling accuracy, the front cover 1 is formed with two positioning rods 30 and the back cover 2 is formed with two receptacles 205 corresponding thereto. Each of the receptacles 205 is formed into a flared shape. The front cover 1 and back cover 2 are further fastened by a safety screw 101 for preventing unauthorized disassembling.

The housing composed of the front and back covers 1, 2 is installed with an LED chip 3, a control module 4 and a battery 5. The control module 4 is electrically connected to the LED chip 3. The battery 5 is electrically connected to the control module 4 for providing alternative power to the LED chip 3. The battery 5 is located at bottom of the back cover 2 and fastened by a depressor 20. A PTC (positive thermal coefficient) heater 6 is arranged near the battery 5. The power line of the PTC heater 6 is connected with a temperature controlled switch 7 in series. The activation threshold temperature of the temperature controlled switch 7 may be set at 5° C. The temperature controlled switch 7 will close its contacts to make the PTC heater 6 work when the temperature is below 5° C. When the inside temperature has risen to the inactivation threshold temperature such as 20° C., the temperature controlled switch 7 will open to stop the PTC heater 6. For the sake of safety, the number of the temperature controlled switch 7 may be two. Besides warming the battery 5, the PTC heater 5 can still warm other electronic components in the LED lamp to keep normal operation in cold environment. Of course, the PTC heater 6 may be replaced with other types of heaters.

Figure 11:
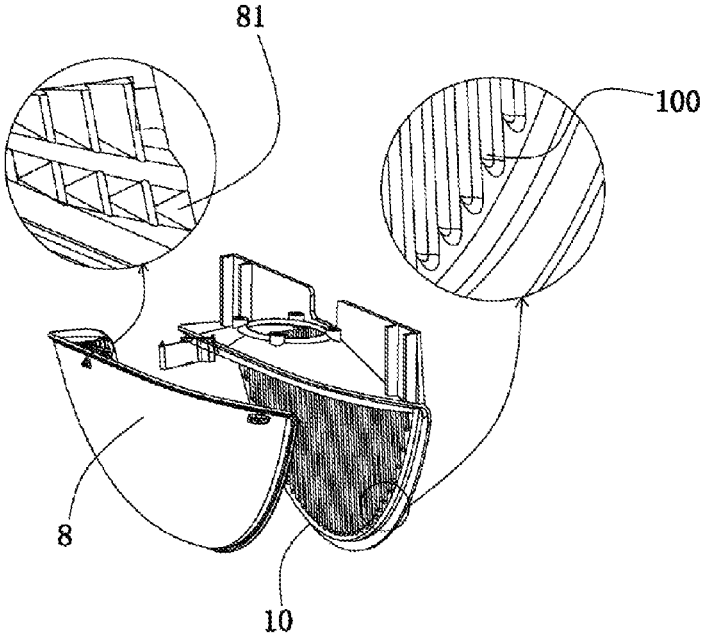
FIG. 11 shows the transparent cap with crystal grids.

Please refer to FIGS. 2, 3 and 11. The bottom of the front cover 1 is provided with a transparent cap 8 with crystal grids 81. A sealing ring 9 is disposed between the transparent cap 8 and the front cover 1. A reflector 10 with protrusions 100 is disposed inside the transparent cap 8. A support 11 bendingly extends from the reflector 10 for being mounted by the LED chip 3. The reflector 10 and the crystal grids 81 can soften the lights from the LED chip 3.

Figure 12:
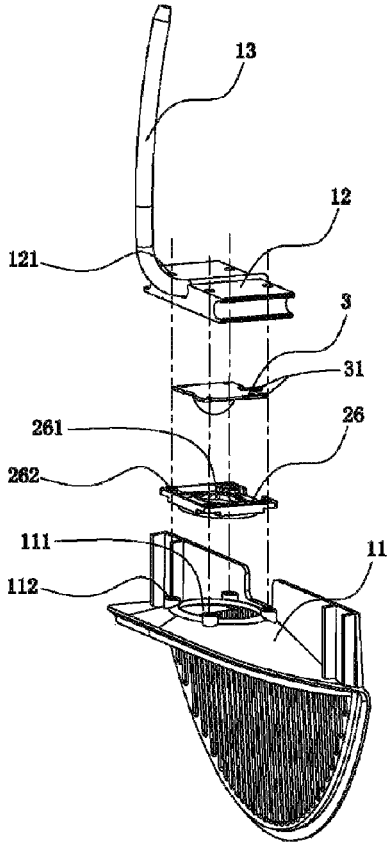
FIG. 12 is an exploded view of the fin module, LED chip and support.

As shown in FIGS. 2, 3 and 12, the LED chip 3 is mounted on the support 11 by a seat 26. The seat 26 is formed with a chamber 261 and the support 11 is formed with a through hole 111. The lights from the LED chip 3 fixed in the chamber 261 penetrate the through hole 111 and reach the space defined by the reflector 10 and transparent cap 8. The back of the LED chip 3 is provided with a fin module 12 for transferring heat from the LED chip 3 to the front cover 1 is made of a thermoconductive material. A copper pipe 13 is connected between the fin module 12 and front cover 1. The fin module 12, LED chip 3 and seat 26 are assembled on the support through fixing holes 121, 262 and 112. The LED chip 3 has two leads 31 electrically connected to the control module 4.

Figure 5:
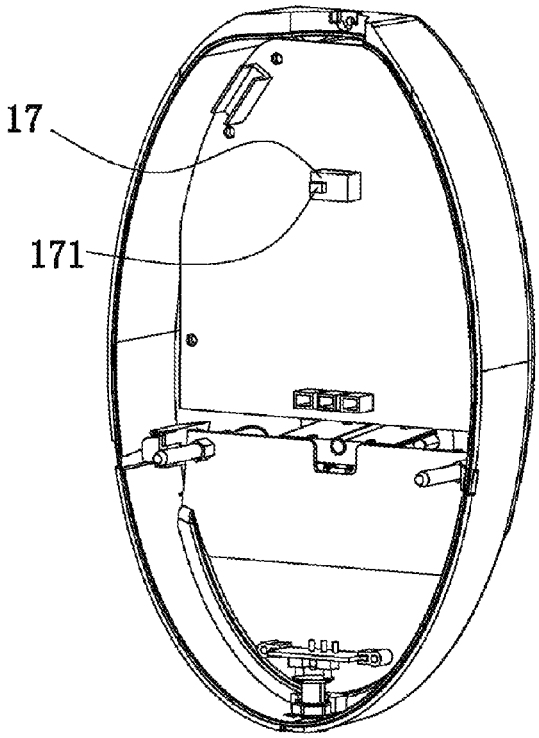
FIG. 5 is a schematic view showing the selection switch.

As shown in FIGS. 1 and 2. The top of the front cover 1 is provided with a window 14 and a light controlled switch 15 under the window 14. A sealing ring 16 is arranged between the light controlled switch 15 and window 14. The light controlled switch 15 is electrically connected to the control module 4. The control module 4 has a selection switch 17 as shown in FIG. 5. The selection switch 17 can be switched by operating the stem 171. The LED lamp can be set into two modes by the selection switch 17: (1) turning on/off by the light controlled switch 15 and (2) turning on/off by an external switch (not shown).

As shown in FIG. 2. The control module 4 can be connected to the back cover 2 by connectors 18, 19.

Figure 13:
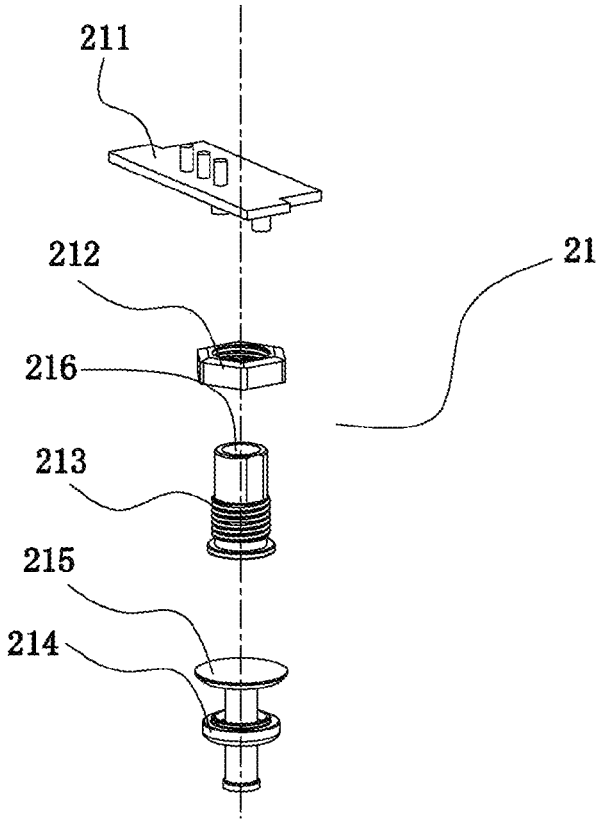
FIG. 13 is an exploded view of the test switch.

As shown in FIGS. 2, 3 and 13. The bottom of the front cover 1 is provided with a test switch 21 including a circuit board 211, a nut 212, a screw 213, a water resistant key seat 214 and a key 215. The circuit board 211 is electrically connected to the control module 4. The screw 213 is formed with a passing hole 216 for receiving the key 215. The water resistant key seat 214 is fixed on the front cover 1 and the key 215 is movably placed in the water resistant key seat 214. When the test switch 21 is operated, the control module 4 will show the parameters and performance by an LED indicator.

Figure 6:
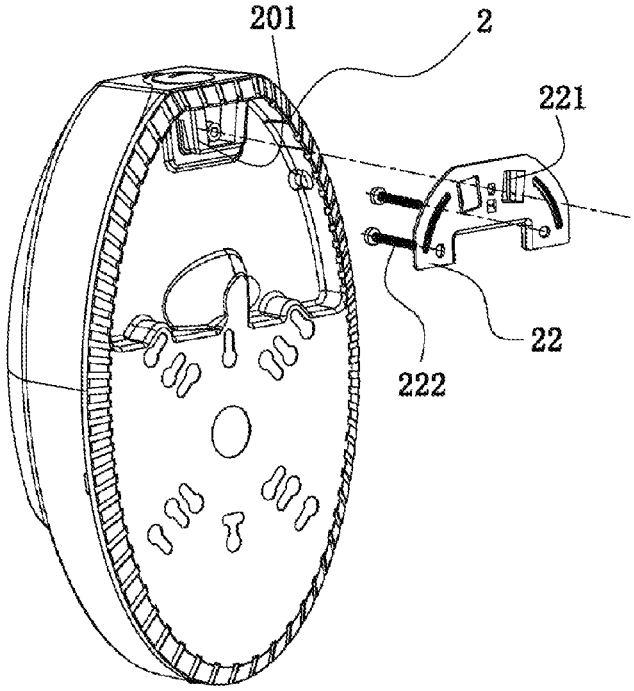
FIG. 6 is a schematic view showing the invention is assembled with the mount plate.
Figure 7:
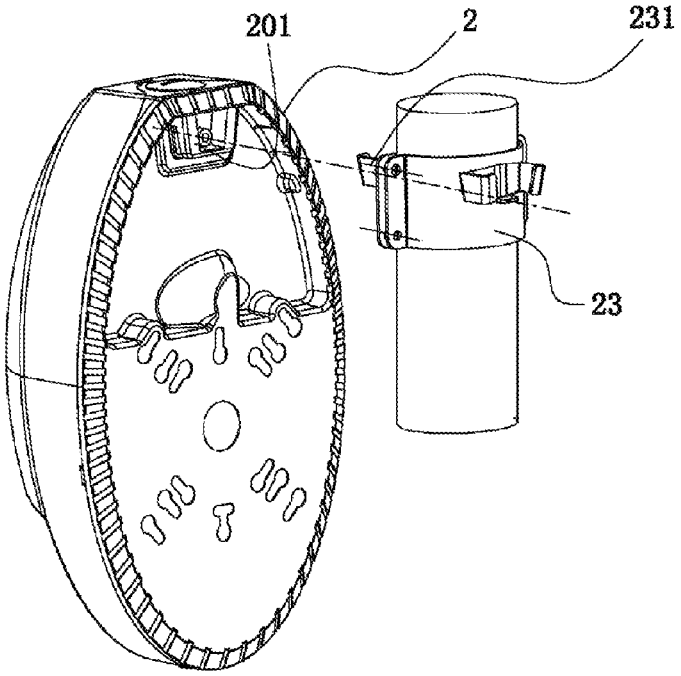
FIG. 7 is a schematic view showing the invention is assembled with the mount ring.
Figure 14:
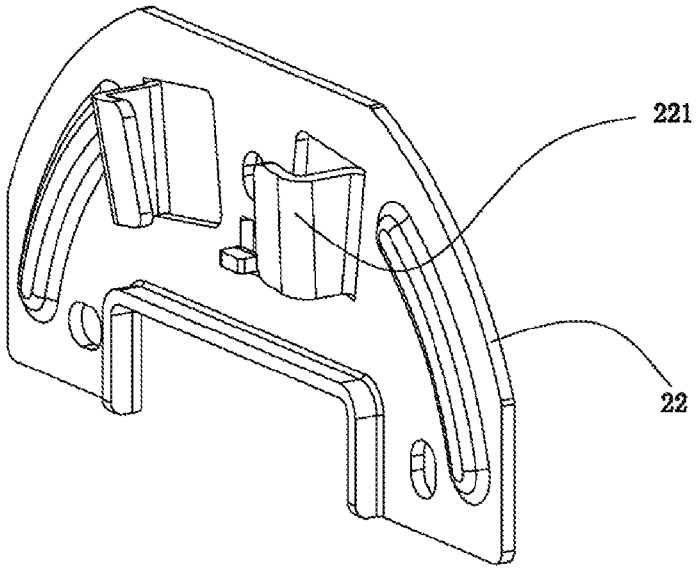
FIG. 14 is a perspective view of the mount plate.

As shown in FIG. 2. The LED lamp can be hung on a wall or tube. The back cover 2 is formed with a U-shaped hanger 201. When the LED lamp is hung on a wall as shown in FIGS. 6 and 14, a mount plate 22 should be used. The mount plate 22 has clamps 221 engaging with the hanger 201 and can be fixed on a wall by screws 222. To prevent the LED lamp from being moved by others, a screw 206 is disposed between the back cover 2 and mount plate 22. The screw 206 fastens the back cover 2 and mount plate 22. When the LED lamp is hung on a tube as shown in FIG. 7, a mount ring 23 should be used. The mount ring 23 also has clamps 231 to engage with the hanger 201.

Figure 4:
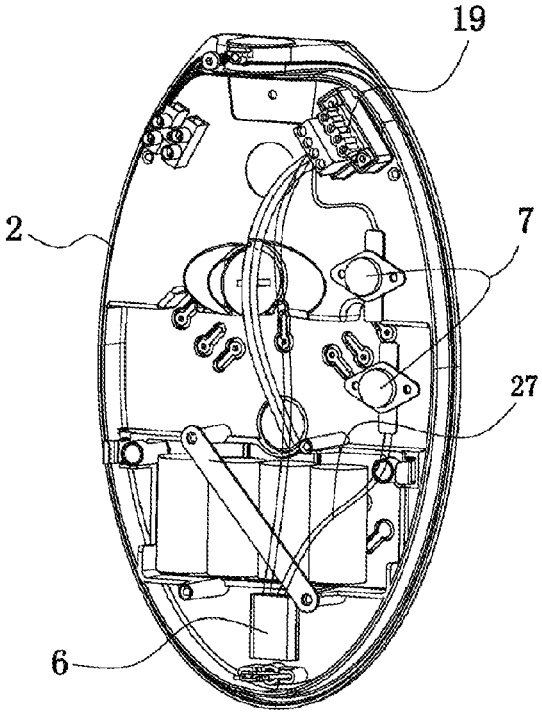
FIG. 4 is a schematic view showing the wiring arrangement of the heater.

Please refer to FIG. 4. One of two wires 27 from the connector 19 is directly connected to the PTC heater 6 and the other one is connected to the temperature controlled switch 7 and the PTC heater 6.

Figure 8:
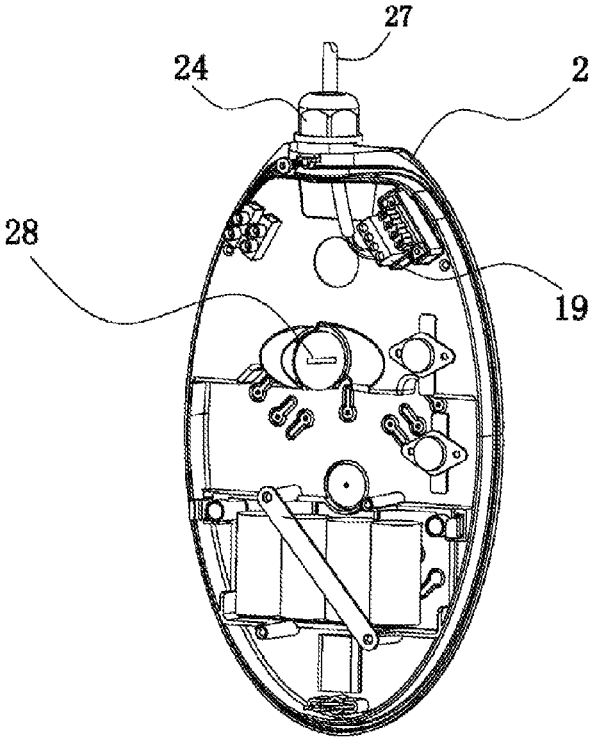
FIG. 8 shows the first wiring arrangement of the invention with an external power source.
Figure 9:
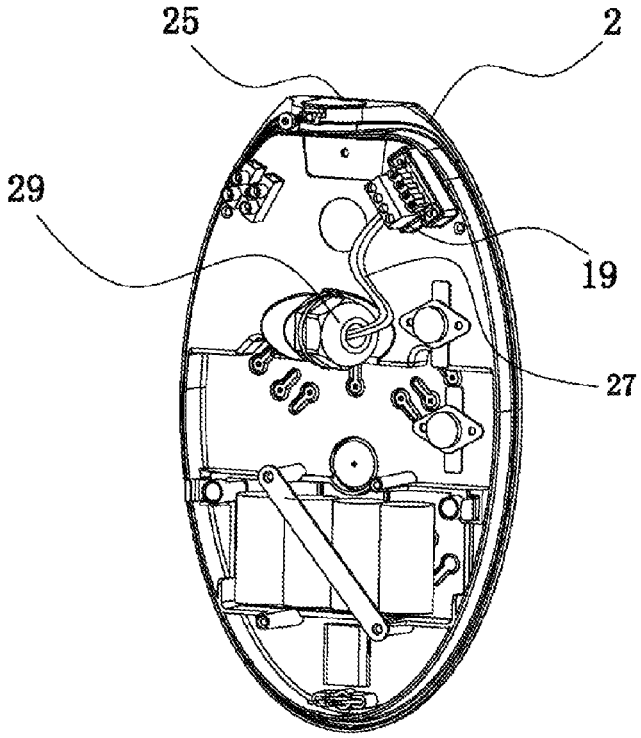
FIG. 9 shows the second wiring arrangement of the invention with an external power source.
Figure 10:
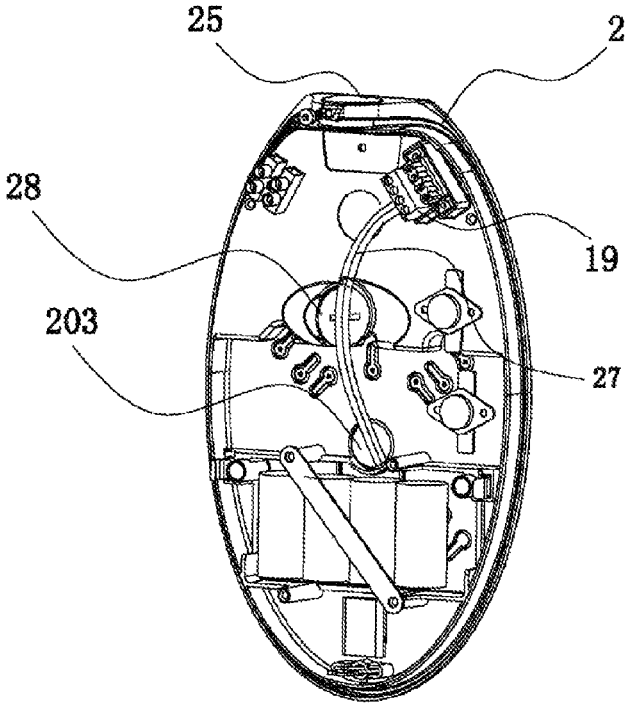
FIG. 10 shows the third wiring arrangement of the invention with an external power source.

Please refer to FIGS. 8-10. The back cover 2 is formed with three wire holes separately at the top, middle and bottom to satisfy different requirement of various countries. Further, the back cover 2 can be additionally adhered with a pad 200. There are three wiring arrangements corresponding to the three wire holes:

(1) As shown in FIG. 8, a water-proof nut 24 is disposed at the top of the back cover 2 and the wires 27 pass through the water-proof nut 24 and connect the connector 19. The wire hole at the middle is covered by a plug 28.

(2) As shown in FIG. 9, the wire hole at the top is covered by a plug 25, a water-proof nut 29 is disposed at the wire hole at the middle, and the wires 27 pass through the water-proof nut 29 and connect the connector 19.

(3) As shown in FIG. 10, the wire hole at the top and the middle are covered by plugs 25, 28, and the wires 27 pass through the wire hole at the bottom and connect the connector 19.

It will be appreciated by persons skilled in the art that the above embodiment has been described by way of example only and not in any limitative sense, and that various alterations and modifications are possible without departure from the scope of the invention as defined by the appended claims.

What is claimed is:

1. A light emitting diode (LED) lamp comprising:
- a housing comprising a front cover and a back cover;
- an LED chip, received in the housing;
- a control module, received in the housing, and electrically connected to the LED chip for driving the LED chip;
- a battery, received in the housing, and electrically connected to the control module for providing alternative power to the LED chip; and
- a heater disposed near the battery and with a temperature controlled switch;
- wherein the front cover is provided with a transparent cap with crystal grids, a sealing ring is disposed between the transparent cap and the front cover, a reflector with protrusions is disposed inside the transparent cap, and a support bendingly extends from the reflector for being mounted by the LED chip.

2. The LED lamp of claim 1, wherein the control module is connected to the back cover by connectors.

3. The LED lamp of claim 1, wherein the front cover is provided with a test switch including a circuit board, a nut, a screw, a water resistant key seat and a key, the circuit board is electrically connected to the control module, the screw is formed with a passing hole for receiving the key, the water resistant key seat is fixed on the front cover and the key is movably placed in the water resistant key seat.

4. The LED lamp of claim 1, wherein the battery is fixed on the back cover and the heater is a PTC (positive thermal coefficient) heater.

5. The LED lamp of claim 1, further comprising a mount plate or a mount ring, a water-proof nut and a plug on the back cover.

6. A light emitting diode (LED) lamp comprising:
- a housing comprising a front cover and a back cover;
- an LED chip, received in the housing;
- a control module, received in the housing, and electrically connected to the LED chip for driving the LED chip;
- a battery, received in the housing, and electrically connected to the control module for providing alternative power to the LED chip; and
- a heater disposed near the battery and with a temperature controlled switch;
- wherein the front cover is made of a thermo-conductive material, and the LED chip is provided with fins for transferring heat from the LED chip to the front cover.

7. The LED lamp of claim 6, wherein a copper pipe is connected between the fins and the front cover.

8. The LED lamp of claim 6, wherein the control module is connected to the back cover by connectors.

9. The LED lamp of claim 6, wherein the front cover is provided with a test switch including a circuit board, a nut, a screw, a water resistant key seat and a key, the circuit board is electrically connected to the Control module, the screw is formed with a passing hole for receiving the key, the water resistant key seat is fixed on the front cover and the key is movably placed in the water resistant key seat.

10. The LED lamp of claim 6, wherein the battery is fixed on the back cover and the heater is a PTC (positive thermal coefficient) heater.

11. The LED lamp of claim 6, further comprising a mount plate or a mount ring, a water-proof nut and a plug on the back cover.

12. A light emitting diode (LED) lamp comprising:
- a housing comprising a front cover and a back cover;
- an LED chip, received in the housing;
- a control module, received in the housing, and electrically connected to the LED chip for driving the LED chip;
- a battery, received in the housing, and electrically connected to the control module for providing alternative power to the LED chip; and
- a heater disposed near the battery and with a temperature controlled switch;
- wherein the front cover is provided with a window and a light controlled switch under the window, a sealing ring is arranged between the light controlled switch and window, and the light controlled switch is electrically connected to the control module.

13. The LED lamp of claim 12, wherein the control module has a selection switch for controlling the LED lamp by the light controlled switch or an external switch.

14. The LED lamp of claim 12, wherein the control module is connected to the back cover by connectors.

15. The LED lamp of claim 12, wherein the front cover is provided with a test switch including a circuit board, a nut, a screw, a water resistant key seat and a key, the circuit board is electrically connected to the control module, the screw is formed with a passing hole for receiving the key, the water resistant key seat is fixed on the front cover and the key is movably placed in the water resistant key seat.

16. The LED lamp of claim 12, wherein the battery is fixed on the back cover and the heater is a PTC (positive thermal coefficient) heater.

17. The LED lamp of claim 12, further comprising a mount plate or a mount ring, a water-proof nut and a plug on the back cover.

* * * * *